US008063867B2

(12) United States Patent
Song et al.

(10) Patent No.: US 8,063,867 B2
(45) Date of Patent: Nov. 22, 2011

(54) LIQUID CRYSTAL DISPLAY AND METHOD OF DRIVING THE SAME

(75) Inventors: Hongsung Song, Gumsi-si (KR); Woongki Min, Daegu (KR); Yonggi Son, Milyang-si (KR); Subyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 582 days.

(21) Appl. No.: 12/318,280

(22) Filed: Dec. 23, 2008

(65) Prior Publication Data

US 2009/0273557 A1 Nov. 5, 2009

(30) Foreign Application Priority Data

Apr. 30, 2008 (KR) ..... 10-2008-0040461

(51) Int. Cl.
*G09G 3/36* (2006.01)

(52) U.S. Cl. ..... 345/99; 345/96

(58) Field of Classification Search ..... 345/87, 345/89, 90, 94–96, 99
See application file for complete search history.

(56) References Cited

U.S. PATENT DOCUMENTS

| | | | | |
|---|---|---|---|---|
| 2005/0041006 | A1* | 2/2005 | Lee et al. | 345/99 |
| 2007/0097057 | A1* | 5/2007 | Shin | 345/98 |
| 2009/0167661 | A1* | 7/2009 | Song et al. | 345/90 |
| 2009/0267878 | A1* | 10/2009 | Song et al. | 345/87 |
| 2009/0295784 | A1* | 12/2009 | Kwon et al. | 345/213 |
| 2010/0289839 | A1* | 11/2010 | Min et al. | 345/691 |
| 2010/0321353 | A1* | 12/2010 | Bae et al. | 345/205 |

* cited by examiner

*Primary Examiner* — Ricardo L Osorio
(74) *Attorney, Agent, or Firm* — McKenna Long & Aldridge, LLP

(57) ABSTRACT

A liquid crystal display and a method of driving the same are disclosed. The liquid crystal display includes a data drive circuit that supplies a data voltage, whose a polarity is periodically inverted, to the data lines, a gate drive circuit, and a timing controller. The gate drive circuit sequentially supplies a first gate pulse synchronized with a first data voltage to gate lines, and sequentially supplies a second gate pulse synchronized with a second data voltage having a polarity opposite a polarity of the first data voltage, to the gate lines. The timing controller generates a pre-gate start pulse for controlling an output of the first gate pulse during a blank period, and then generates a real gate start pulse for controlling an output of the second gate pulse during an initial period of a frame period following the blank period.

8 Claims, 4 Drawing Sheets

LIQUID CRYSTAL DISPLAY AND METHOD OF DRIVING THE SAME

This application claims the benefit of Korea Patent Application No. 10-2008-0040461 filed on Apr. 30, 2008, which is incorporated herein by reference for all purposes as if fully set forth herein.

BACKGROUND OF THE INVENTION

1. Field of the Invention

The present invention relate to a liquid crystal display and a method of driving the same.

2. Discussion of the Related Art

Active matrix type liquid crystal displays display a moving picture using a thin film transistor (TFT) as a switching element. The active matrix type liquid crystal displays have been implemented in televisions as well as display devices in portable devices, such as office equipment and computers, because of the thin profile of the active matrix type liquid crystal displays. Accordingly, cathode ray tubes (CRT) are being rapidly replaced by the active matrix type liquid crystal displays.

The active matrix type liquid crystal display includes data lines and gate lines crossing each other, and liquid crystal cells arranged at each crossing of the data lines and the gate lines in a matrix format. A thin film transistor (TFT) is formed at each crossing of the data lines and the gate lines. As shown in FIG. 1, data driver integrated circuits (ICs) of a liquid crystal display supply a positive or negative data voltage to data lines during low logic periods of a source output enable signal (SOE). Gate driver ICs of the liquid crystal display sequentially supply gate pulses that are synchronized with the positive/negative data voltage to gate lines G1 to G3 during low logic periods of a gate output enable signal (GOE). Hence, a liquid crystal cell of 1 line charged to the data voltage is selected.

If a DC voltage is applied to a liquid crystal layer of the liquid crystal display for a long time, negative ions move in the same vector direction and positive ions move in a vector direction opposite the vector direction of the negative ions based upon a polarity of an electric field applied to liquid crystals. Hence, the ions in the liquid crystal layer are polarized. As time elapses, the accumulation amount of negative ions and the accumulation amount of positive ions increase. As a result, an alignment layer is degraded and alignment characteristics of the liquid crystal are also degraded. In other words, the application of the DC voltage to the liquid crystal layer for a long time causes stains on the display screen, and the size of the stains increases as time elapsed. To solve the stain problem, a liquid crystal material with a low dielectric constant has been developed, or a method for improving an alignment material or an alignment method has been attempted. However, it takes a long time and great expense to develop a material used in the method. Further, the use of the liquid crystal material with the low dielectric constant may reduce drive characteristics of the liquid crystal. According to the experimental findings, as the amount of impurities ionized inside the liquid crystal layer increases and an acceleration factor becomes large, an appearance time of the stains becomes more rapid. The acceleration factor may include a temperature, time, a DC drive of the liquid crystal, and the like. For example, when a period during which a DC voltage of the same polarity is applied to the liquid crystal layer becomes longer at a high temperature, the stains worsen and the appearance time of the stains becomes more rapid. Because the stains non-uniformly appear between display panels manufactured through the same manufacture line, the stain problem cannot be solved only by development of new material or an improvement of process.

SUMMARY OF THE INVENTION

Accordingly the present invention is directed to a liquid crystal display and method of driving the same that substantially obviates one or more of the problems due to limitations and disadvantages of the related art.

An advantage of the present invention is to provide a liquid crystal display and a method of driving the same capable of suppressing a staining phenomenon caused by the polarization and accumulation of ions.

Additional features and advantages of the invention will be set forth in the description which follows, and in part will be apparent from the description, or may be learned by practice of the exemplary embodiments. These and other advantages of the invention will be realized and attained by the structure particularly pointed out in the written description and claims hereof as well as the appended drawings.

To achieve these and other advantages and in accordance with the purpose of the invention, as embodied and broadly described, a liquid crystal display comprises a liquid crystal display panel including a plurality of liquid crystal cells arranged at crossings of a plurality of data lines and a plurality of gate lines in a matrix format, a data drive circuit that supplies a data voltage, whose a polarity is periodically inverted, to the data lines, a gate drive circuit that sequentially supplies a first gate pulse synchronized with a first data voltage to the gate lines during a frame period and sequentially supplies a second gate pulse synchronized with a second data voltage, that has a polarity opposite a polarity of the first data voltage, to the gate lines, and a timing controller that generates a pre-gate start pulse for controlling an output of the first gate pulse during a blank period, and then generates a real gate start pulse for controlling an output of the second gate pulse during an initial period of the frame period following the blank period.

The timing controller generates dummy digital video data during the blank period, and then generates digital video data to be displayed on the liquid crystal display panel during the frame period.

After the data drive circuit converts the dummy digital video data into a dummy positive or negative analog data voltage to supply the dummy positive/negative analog data voltage to the data lines, the data drive circuit converts the digital video data into a positive or negative analog data voltage to supply the positive/negative analog data voltage to the data lines.

The timing controller extends a supply of pulses of a data enable signal, that are generated at predetermined time intervals during the frame period, to the blank period to generate a dummy data enable signal. The timing controller generates the pre-gate start pulse based on the dummy data enable signal during the blank period.

The timing controller includes a first counter that counts the data enable signal, and a gate start pulse generating unit that receives the data enable signal, an option information, a line number information, and an output signal of the first counter to generate the pre-gate start pulse and the real gate start pulse.

The gate start pulse generating unit includes a second counter that counts the data enable signal depending on clocks generated at time intervals, that are smaller than a width of the pulse of the data enable signal, to detect the pulse width of the data enable signal, an extension unit that generates the dummy data enable signal during the blank period based on an information for the pulse width of the data enable signal received from the second counter, a pre-gate start pulse time detecting unit that detects a pulse time of the dummy data enable signal synchronized with a pulse time of the line number information and generates the pre-gate start pulse for the pulse time of the dummy data enable signal, a periodic checking unit that decides a time interval indicating the option information based on a count value of the data enable signal received from the first counter, a periodic selecting unit that receives an output of the periodic checking unit to invert a selection signal for the pulse time of the dummy data enable signal synchronized with pulses of the option information, and a pulse generating unit that generates the pre-gate start pulse and the real gate start pulse in response to the selection signal.

In another aspect of the present invention, a method of driving a liquid crystal display including a liquid crystal display panel, that includes a plurality of liquid crystal cells arranged at crossings of a plurality of data lines and a plurality of gate lines in a matrix format, the method comprises supplying a data voltage, whose a polarity is periodically inverted, to the data lines, sequentially supplying a first gate pulse synchronized with a first data voltage to the gate lines during a frame period, and sequentially supplies a second gate pulse synchronized with a second data voltage, that has a polarity opposite a polarity of the first data voltage, to the gate lines, generating a pre-gate start pulse for controlling an output of the first gate pulse during a blank period, and generating a real gate start pulse for controlling an output of the second gate pulse during an initial period of the frame period following the blank period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the present inventions of which are illustrated in the accompanying drawings.

Figure 1:
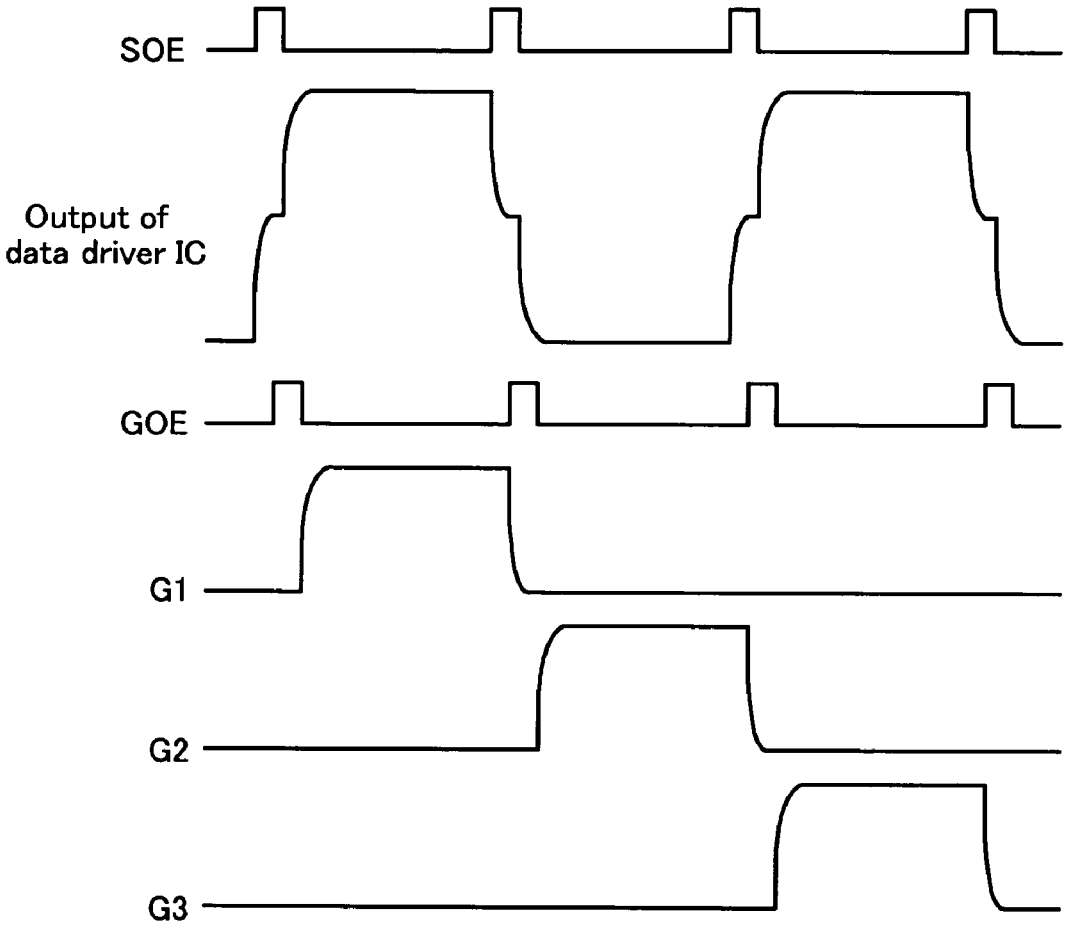
FIG. 1 (Related Art)
FIG. 1 is a waveform diagram illustrating driving signals of a liquid crystal display.
Figure 2:
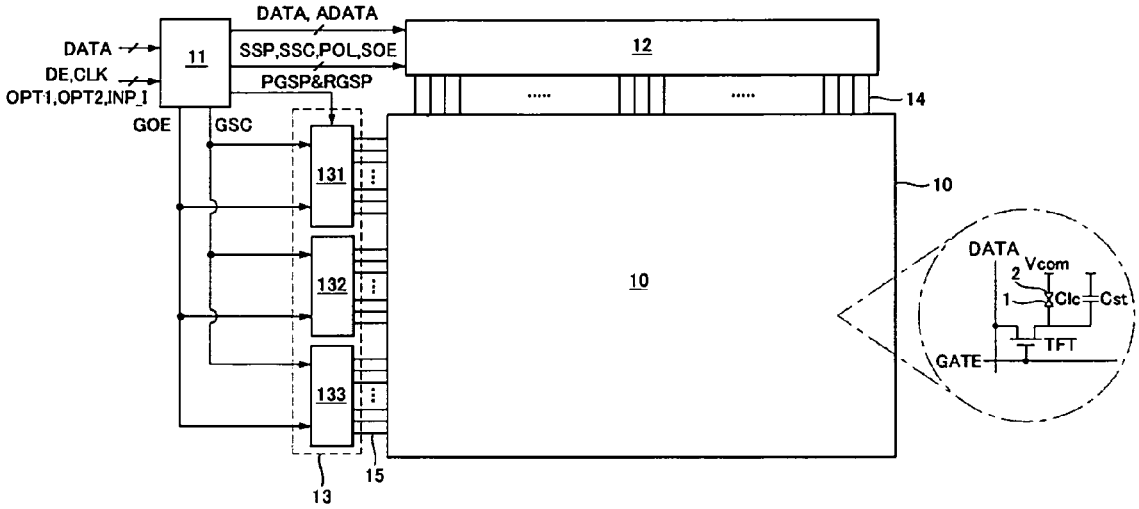
FIG. 2 is a block diagram of a liquid crystal display according to an exemplary embodiment.

As shown in FIG. 2, a liquid crystal display according to an exemplary embodiment includes a liquid crystal display panel 10, a timing controller 11, a data drive circuit 12, and a gate drive circuit 13. The data drive circuit 12 includes a plurality of data driver integrated circuits (IC) (not shown). The gate drive circuit 13 includes a plurality of gate driver ICs 131 to 133.

In the liquid crystal display panel 10, a liquid crystal layer is formed between two glass substrates. The liquid crystal display panel 10 includes m×n liquid crystal cells Clc arranged at each crossing of m data lines 14 and n gate lines 15 in a matrix format.

The data lines 14, the gate lines 15, thin film transistors (TFTs), and a storage capacitor Cst are formed on a lower glass substrate of the liquid crystal display panel 10. The liquid crystal cells Clc are connected to the TFTs and are driven by an electric field between pixel electrodes 1 and a common electrode 2. A black matrix, a color filter, and a common electrode 2 are formed on an upper glass substrate of the liquid crystal display panel 10. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizing plates are respectively attached to the upper and lower glass substrates of the liquid crystal display panel 10. Alignment layers for setting a pre-tilt angle of the liquid crystal are respectively formed on the upper and lower glass substrates.

Figure 3:
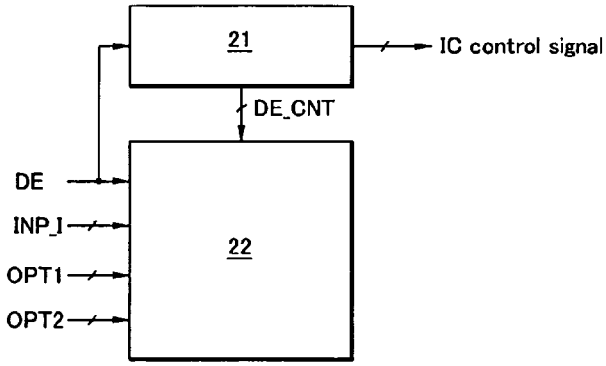
FIG. 3 schematically illustrates a gate start pulse generating circuit of a timing controller shown in FIG. 2.
Figure 4:
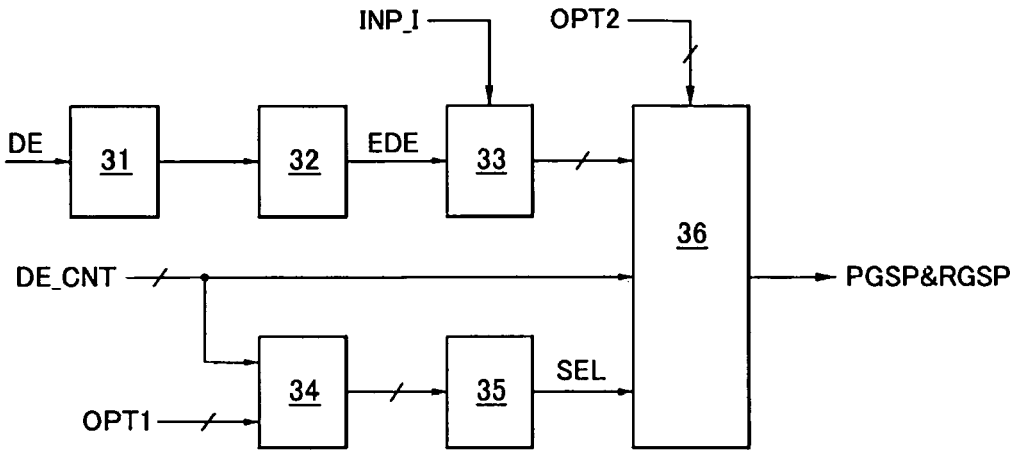
FIG. 4 is a block diagram illustrating in detail a gate start pulse generating unit shown in FIG. 3.

The timing controller 11 receives timing signals, such as a data enable signal DE and a dot clock CLK, and additionally receives option informations, such as first and second option informations OPT1 and OPT2 and an information INP_I for the number of lines. The timing controller 11 counts the data enable signal DE and the dot clock CLK, generates control signals for controlling operation timing of the data drive circuit 12 and operation timing of the gate drive circuit 13, and supplies digital video data to the data drive circuit 12. The control signals include a data timing control signal and a gate timing control signal. The timing controller 11 generates a pre-gate start pulse PGSP based on the first and second option informations OPT1 and OPT2 and the line number information INP_I. The pre-gate start pulse PGSP will be described in detail later. The timing controller 11 supplies effective digital video data to be displayed on the liquid crystal display panel 10 to the data drive circuit 12 every 1 frame period. The timing controller 11 supplies dummy digital video data, that is not displayed on the liquid crystal display panel 10, to the data drive circuit 12 during a blank period between frame periods. A circuit configuration of the timing controller 11 is illustrated in FIGS. 3 and 4.

The gate timing control signal includes a pre-gate start pulse PGSP, a real gate start pulse RGSP, a gate shift clock GSC, a gate output enable signal GOE, and so on.

The pre-gate start pulse PGSP is generated earlier than the real gate start pulse RGSP at time intervals of 2 to 10 seconds depending on the first option information OPT1. The pre-gate start pulse PGSP is generated earlier than the real gate start pulse RGSP by a scan time of the lines indicated by the line number information INP_I during the blank period when the effective data to be displayed is not supplied. The number of lines means the number of horizontal lines of the liquid crystal cells arranged in the matrix format. Accordingly, if the number of lines depending on the line number information INP_I is N (where N is a positive integer), the pre-gate start pulse (PGSP) is generated earlier than the real gate start pulse (RGSP) by N horizontal periods. A line indicated by the line number information INP_I must be a previous line charged to a data voltage with a polarity opposite a polarity of a real data voltage to be displayed. As a result, the pre-gate start pulse PGSP is generated earlier than the real gate start pulse RGSP during the black period at time intervals of about 2 to 10 seconds. The real gate start pulse RGSP is a signal corresponding to an existing gate start pulse, and is generated when a scan operation of data starts every 1 frame period (i.e., as soon as each frame period starts).

The pre-gate start pulse PGSP and the real gate start pulse RGSP are applied to the first gate driver IC 131 to thereby allows a shift operation of a gate pulse supplied by the first gate driver IC 131 to start. Hence, the first gate driver IC 131 sequentially supplies gate pulses to the gate lines 15 connected to output terminals of the first gate driver IC 131 in response to the pre-gate start pulse PGSP, and then transmits a carry signal to the second gate driver IC 132. The second gate driver IC 132 receives a carry signal from the first gate driver IC 131 as a gate start pulse and starts to perform a shift operation of the gate pulse. The second gate driver IC 132 sequentially supplies gate pulses to the gate lines 15 connected to output terminals of the second gate driver IC 132, and then transmits a carry signal to the third gate driver IC 133. The third gate driver IC 133 receives the carry signal from the second gate driver IC 132 as a gate start pulse and starts to perform a shift operation of the gate pulse. The third gate driver IC 133 sequentially supplies gate pulses to the gate lines 15 connected to output terminals of the third gate driver IC 133. The real gate start pulse RGSP is generated every 1 frame period, and the pre-gate start pulse PGSP is generated at predetermined time intervals during a blank period between frame periods. The gate shift clock GSC is a clock signal for shifting the gate start pulses PGSP and RGSP. The gate output enable signal GOE controls outputs of the gate driver ICs 131 to 133. The gate driver ICs 131 to 133 output gate pulses during a low logic period of the gate output enable signal GOE, i.e., during a period of time ranging from immediately after a falling time of a pulse to immediately before a rising time of a next pulse. The gate driver ICs 131 to 133 do not generate the gate pulse during a high logic period of the gate output enable signal GOE.

The data timing control signal includes a source start pulse SSP, a source sampling clock SSC, a polarity control signal POL, a source output enable signal SOE, and so on. The source start pulse SSP is applied to the data driver IC of the data drive circuit 12 receiving a first digital video data to thereby indicate a start time of data sampling. The source sampling clock SSC is a clock signal for shifting the source start pulse SSP and directs a data latch operation to the data drive circuit 12 based on a rising or falling edge. The polarity control signal POL controls a polarity of a data voltage output from the data drive circuit 12. The source output enable signal SOE controls an output of the data drive circuit 12. If digital video data and a mini low-voltage differential signaling (LVDS) clock are transmitted between the timing controller 11 and the data drive circuit 12 in a mini LVDS interface, the source start pulse SSP may be omitted because a first clock generated after a reset signal of the mini LVDS clock serves as a start pulse.

The timing controller 11 is connected to a system board through an interface circuit. A scaler and an interface transmitting circuit are mounted on the system board, and thus the digital video data, the timing signals, and the option informations are supplied to the timing controller 11. The option informations are stored in an updatable memory of the system board or a memory inside the timing controller 11. The second option information OPT2 can be obtained by a voltage applied to an option terminal of the timing controller 11. More specifically, when the option terminal of the timing controller 11 is connected to a ground level voltage source GND through a pull-down resistor, the second option information OPT2 is generated at a low logic level "0" indicating a normal mode. When the option terminal of the timing controller 11 is connected to a voltage power source VCC, the second option information OPT2 is generated at a high logic level "1" indicating a stain prevention mode. In the normal mode, the timing controller 11 does not generate the pre-gate start pulse PGSP. On the other hand, in the stain prevention mode, the timing controller 11 generates the pre-gate start pulse PGSP earlier than the real gate start pulse RGSP at time intervals of 2 or more seconds indicated by the first option information OPT1.

The liquid crystal cells are charged to a data voltage of a previous line with a polarity opposite a polarity of a real data voltage to be displayed for on-time (scan time) of the gate pulse generated by the pre-gate start pulse PGSP, and then are charged to the real data voltage to be displayed for on-time (scan time) of the gate pulse generated by the real gate start pulse RGSP. Accordingly, the liquid crystal display according to the exemplary embodiment periodically inverts polarities of the data voltages, to which the liquid crystal cells are charged, during 1 frame period to change movement vectors of impurity ions in the liquid crystal layer. In other words, a phenomenon, in which the ions are dividedly accumulated depending on the polarities of the ions, can be prevented by changing a direction of the movement vector.

The data drive circuit 12 latches the dummy digital video data and the digital video data DATA under the control of the timing controller 11. The data drive circuit 12 converts the digital video data DATA into an analog positive or negative gamma compensation voltage in response to the polarity control signal POL. The data drive circuit 12 generates a data voltage whose a polarity is periodically inverted. More specifically, if the timing controller 11 outputs the polarity control signal POL, whose a logic level is inverted every 1 horizontal period, the data drive circuit 12 inverts a polarity of the data voltage every 1 horizontal period in response to the polarity control signal POL. In other words, the data drive circuit 12 inverts a polarity of the data voltage in a vertical 1-dot inversion scheme to supply the data voltage, whose the polarity is inverted, to the data lines 14. If the timing controller 11 outputs the polarity control signal POL, whose a logic level is inverted every 2 horizontal periods, the data drive circuit 12 inverts a polarity of the data voltage every 2 horizontal periods in response to the polarity control signal POL. In other words, the data drive circuit 12 inverts a polarity of the data voltage in a vertical 2-dot inversion scheme to supply the data voltage, whose the polarity is inverted, to the data lines 14. A positive or negative analog video data voltage output by the data drive circuit 12 is supplied to the data lines 14.

The gate drive circuit 13 sequentially supplies gate pulses to the gate lines 15 in response to the gate timing signal received from the timing controller 11. The gate drive circuit 13 sequentially supplies gate pulses synchronized with a pre-charge data voltage to the gate lines 15 during 1 frame period, and then sequentially supplies gate pulses synchronized with a real data voltage, whose a polarity is opposite to a polarity of the pre-charge data voltage, to the gate lines 15.

FIG. 3 schematically illustrates a circuit part of the timing controller 11 generating the gate start pulses PGSP and RGSP.

As shown in FIG. 3, the timing controller 11 includes a first counter 21 and a gate start pulse generating unit 22.

The first counter 21 counts the data enable signal DE to supply a count value DE_CNT to the gate start pulse generating unit 22. The data enable signal DE indicates a period during which the digital video data DATA to be displayed on 1 line is supplied. Accordingly, one cycle of the data enable signal DE is 1 horizontal period corresponding to a scan period of 1 line of the liquid crystal display panel 10. Therefore, the count value DE_CNT of the data enable signal DE indicates the number of lines (i.e., the number of horizontal periods) of the liquid crystal display panel 10.

The gate start pulse generating unit 22 receives the data enable signal DE, the first and second option informations OPT1 and OPT2, the line number information INP_I, and the count value DE_CNT of the first counter 21 to generate the pre-gate start pulse PGSP and the real gate start pulse RGSP.

All or a portion of the circuit part shown in FIG. 3 may be implemented in a separate chip formed separately from the timing controller 11.

FIG. 4 illustrates in detail the gate start pulse generating unit 22.

As shown in FIG. 4, the gate start pulse generating unit 22 includes a second counter 31, an extension unit 32, a pre-gate start pulse time detecting unit 33, a periodic checking unit 34, a periodic selecting unit 35, and a pulse generating unit 36.

The second counter 31 counts the data enable signal DE as the dot clock CLK or an internal clock generated by an internal generator of the timing controller 11 to thereby count pulses of the data enable signal DE. The dot clock CLK or the internal clock generated inside the timing controller 11 is generated at time intervals that are smaller than a width of the pulse of the data enable signal DE. The second counter 31 generates the count value DE_CNT of the data enable signal DE, i.e., an information for the pulse width of the data enable signal DE.

Figure 5:
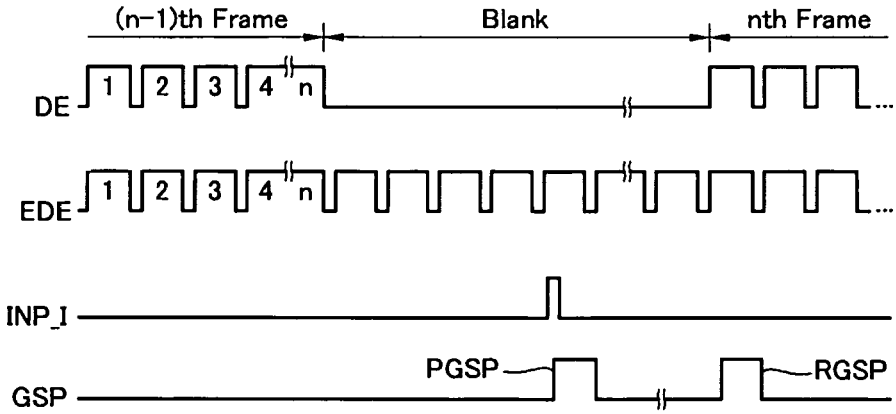
FIG. 5 is a waveform diagram illustrating an input signal and an output signal of the gate start pulse generating unit.

The extension unit 32 receives the pulse width information of the data enable signal DE from the second counter 31. The extension unit 32 checks the data enable signal DE, decides a blank period, during which effective data is not supplied, between frame periods, and generates a predetermined number of dummy pulses during the blank period based on the pulse width information of the data enable signal DE. The dummy pulse has the same width and the same cycle as the pulse of the data enable signal DE. As a result, the extension unit 32 supplies the signal having the same properties as the data enable signal DE during the blank period to generate a dummy data enable signal EDE, that is sequential to the data enable signal DE, during the blank period as shown in FIG. 5.

The pre-gate start pulse time detecting unit 33 detects a dummy pulse time synchronized with a pulse time of the line number information INP_I generated during the blank period to generate an output indicating the dummy pulse. The pulse of the line number information INP_I indicates a time point that is earlier than a start time point of a frame period by "i" horizontal periods (where i is a natural number), so that the data voltage with a polarity opposite a polarity of the data voltage, to which a reference line is charged, supports a previous line of the reference line. For example, if the data voltage supplied to the data lines 14 is inverted in the vertical 1-dot inversion scheme, the line number information INP_I indicates a time point that is earlier than a start time point of a frame period, during which the real gate start pulse RGSP is generated, by odd-numbered horizontal periods. If the data voltage supplied to the data lines 14 is inverted in the vertical 2-dot inversion scheme, the line number information INP_I indicates a time point that is earlier than a start time point of a frame period, during which the real gate start pulse RGSP is generated, by 1, 2, 5, 6, 7, or 8 horizontal periods.

The periodic checking unit 34 decides a time interval between the pulses of the first option information OPT1 based on the count value DE_CNT of the data enable signal DE. The pulses of the first option information OPT1 are generated at time intervals of 2 to 10 seconds.

The periodic selecting unit 35 receives an output of the periodic checking unit 34 to detect the dummy pulse of the data enable signal DE synchronized with the pulse of the first option information OPT1. The periodic selecting unit 35 inverts a logic level of the selection signal SEL as a high logic level when the dummy pulse is generated.

The pulse generating unit 36 receives the second option information OPT2 and the selection signal SEL from the periodic selecting unit 35. When the second option information OPT2 is a high logic level "1" indicating the stain prevention mode, the pulse generating unit 36 generates the pre-gate start pulse PGSP in response to the selection signal SEL, and then the pulse generating unit 36 generates the real gate start pulse RGSP as soon as a frame period starts. When the second option information OPT2 is a low logic level "0" indicating the normal mode, the pulse generating unit 36 does not generate the pre-gate start pulse PGSP and generates only the real gate start pulse RGSP.

FIG. 5 illustrates an input signal and an output signal of the gate start pulse generating unit 22.

As shown in FIG. 5, the gate start pulse generating unit 22 extends a supply of the data enable signal DE to the blank period to generate the dummy data enable signal EDE during the blank period. The gate start pulse generating unit 22 detects the dummy pulse of the data enable signal DE synchronized with the pulse of the line number information INP_I to generate the pre-gate start pulse PGSP. Sequentially, the gate start pulse generating unit 22 generates the real gate start pulse RGSP as soon as a frame period starts.

Figure 6:
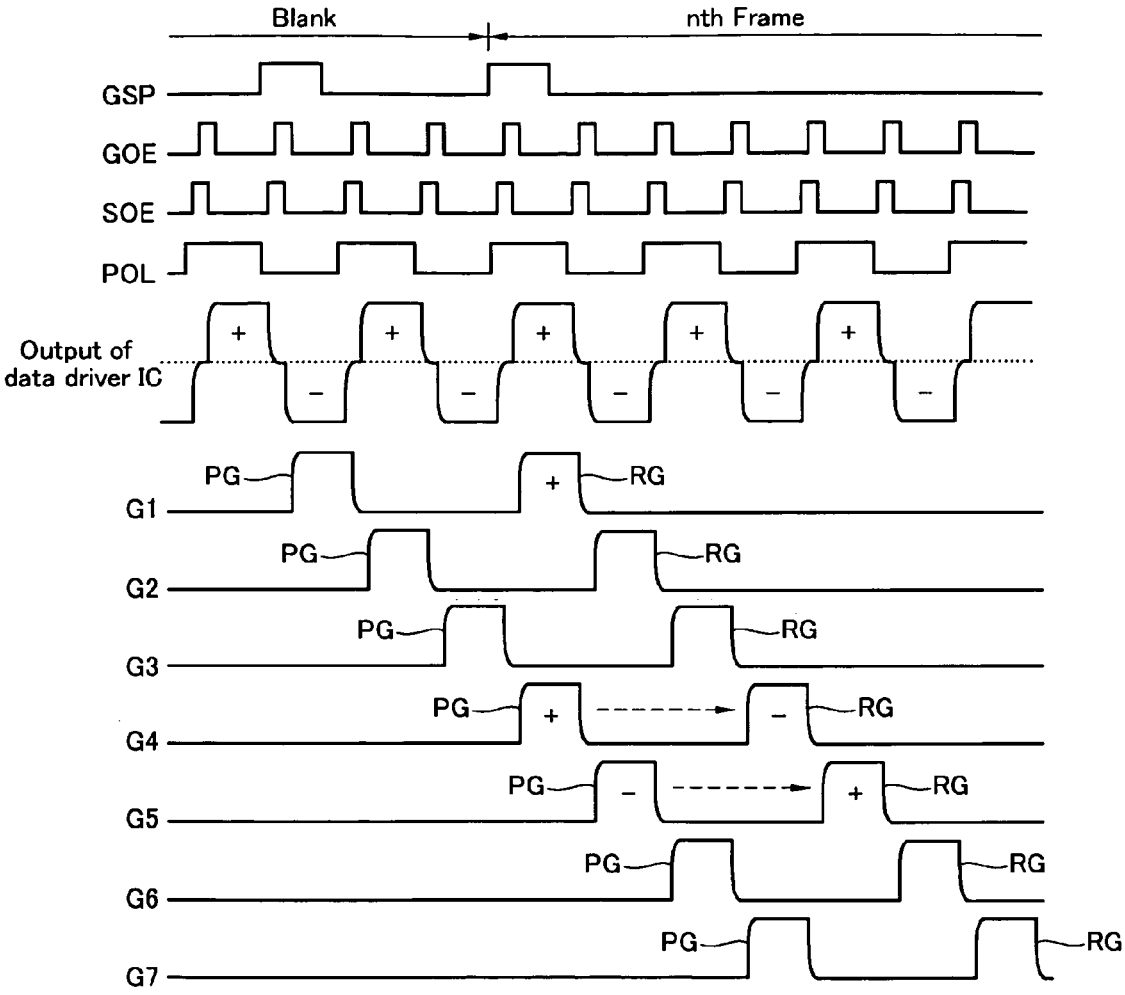
FIG. 6 is a waveform diagram illustrating gate pulses generated by a gate drive circuit and a data voltage generated by a data drive circuit.

FIG. 6 is a waveform diagram illustrating the gate pulses generated by the gate drive circuit 13 and the data voltage generated by the data drive circuit 12 depending on the gate start pulses PGSP and RGSP generated by the gate start pulse generating unit 22.

As shown in FIG. 6, the data drive circuit 12 generates a dummy data voltage during the blank period in response the dummy digital video data received from the timing controller 11. The data drive circuit 12 inverts a polarity of the data voltage in the vertical 1-dot inversion scheme to outputs the inverted data voltage. In the stain prevention mode, while the gate drive circuit 13 sequentially supplies pre-gate pulses PG to the gate lines in response to the pre-gate start pulse PGSP, the gate drive circuit 13 sequentially supplies real gate pulses RG to the gate lines in response to the real gate start pulse RGSP input after 3 horizontal periods from the supplying of the pre-gate start pulse PGSP. Accordingly, the real gate pulse RG supplied to the (n−3)-th gate line and the pre-gate pulse PG supplied to the n-th gate line are simultaneously generated, where n is 4 or more integer. For example, the real gate pulse RG supplied to the gate line G1 and the pre-gate pulse PG supplied to the gate line G4 are simultaneously generated.

The n-th TFT is turned on at the same as the (n−3)-th TFT in response to the pre-gate pulse. Hence, the n-th TFT supplies the real data voltage of the (n−3)-th line to the liquid crystal cells of the n-th line connected to the n-th TFT as the pre-charge data voltage, and then supplies the real data voltage to be displayed on the n-th line to the liquid crystal cells of the n-th line in response to the real gate pulse. A polarity of the pre-charge data voltage is opposite to a polarity of the real data voltage. Accordingly, in the stain prevention mode, the liquid crystal cells are charged to the pre-charge data voltage, and then are charged to the real data voltage with a polarity opposite a polarity of the pre-charge data voltage.

In the stain prevention mode, because a polarity of the data voltage to which the liquid crystal cells are charged is inverted once during 1 frame period, movement vectors of the ions in the liquid crystal layer depend on changes in the polarity of the data voltage. Accordingly, the stain appearing by the polarization and accumulation of the ions in the liquid crystal layer can be prevented.

In the normal mode, because the pre-gate start pulse PGSP is not input, the gate drive circuit 13 sequentially supplies the real gate pulses to the gate lines 15 in response to the real gate start pulse RGSP. In the normal mode, the liquid crystal cells are charged to only the real data voltage.

Although FIG. 6 illustrates an example of the pre-gate start pulse PGSP generated earlier than the real gate start pulse RGSP by 3 horizontal periods, the pre-gate start pulse PGSP may be generated at any time synchronized with the data voltage with a polarity opposite a polarity of the real data voltage. For example, when the data drive circuit 12, as shown in FIG. 6, generates the data voltage whose a polarity is inverted in the vertical 1-dot inversion scheme, the pre-gate start pulse PGSP may be generated earlier than the real gate start pulse RGSP by 1, 5, or 7 horizontal periods. When the data drive circuit 12 generates the data voltage whose a polarity is inverted in the vertical 2-dot inversion scheme, the pre-gate start pulse PGSP may be generated earlier than the real gate start pulse RGSP by 2 or 6 horizontal periods. In other words, the pre-gate start pulse PGSP may be generated at any time synchronized with the data voltage with a polarity opposite a polarity of the real data voltage.

As described above, in the liquid crystal display and the method of driving the same according to the exemplary embodiment, the liquid crystal cells are charged to the pre-data voltage at predetermined time intervals during 1 frame period, and then are charged to the real data voltage with a polarity opposite a polarity of the pre-data voltage. As a result, the movement vectors of the ions in the liquid crystal layer change at predetermined time intervals, and the stain appearing by the polarization and accumulation of the ions can be prevented.

It will be apparent to those skilled in the art that various modifications and variations can be made in the embodiments without departing from the spirit or scope of the invention. Thus, it is intended that embodiments of the invention cover the modifications and variations of this invention provided they come within the scope of the appended claims and their equivalents.

What is claimed is:

1. A liquid crystal display comprising:

a liquid crystal display panel including a plurality of liquid crystal cells arranged at crossings of a plurality of data lines and a plurality of gate lines in a matrix format;

a data drive circuit that supplies a data voltage, whose a polarity is periodically inverted, to the data lines;

a gate drive circuit that sequentially supplies a first gate pulse synchronized with a first data voltage to the gate lines during a frame period and sequentially supplies a second gate pulse synchronized with a second data voltage, that has a polarity opposite a polarity of the first data voltage, to the gate lines; and a timing controller that generates a pre-gate start pulse for controlling an output of the first gate pulse during a blank period, and then generates a real gate start pulse for controlling an output of the second gate pulse during an initial period of the frame period following the blank period.

2. The liquid crystal display of claim 1, wherein the timing controller generates dummy digital video data during the blank period, and then generates digital video data to be displayed on the liquid crystal display panel during the frame period, wherein after the data drive circuit converts the dummy digital video data into a dummy positive or negative analog data voltage to supply the dummy positive/negative analog data voltage to the data lines, the data drive circuit converts the digital video data into a positive or negative analog data voltage to supply the positive/negative analog data voltage to the data lines.

3. The liquid crystal display of claim 1, wherein the timing controller extends a supply of pulses of a data enable signal, that are generated at predetermined time intervals during the frame period, to the blank period to generate a dummy data enable signal, the timing controller generates the pre-gate start pulse based on the dummy data enable signal during the blank period.

4. The liquid crystal display of claim 3, wherein the timing controller includes:

a first counter that counts the data enable signal; and a gate start pulse generating unit that receives the data enable signal, an option information, a line number information, and an output signal of the first counter to generate the pre-gate start pulse and the real gate start pulse.

5. The liquid crystal display of claim 4, wherein the gate start pulse generating unit includes:

a second counter that counts the data enable signal depending on clocks generated at time intervals, that are smaller than a width of the pulse of the data enable signal, to detect the pulse width of the data enable signal;

an extension unit that generates the dummy data enable signal during the blank period based on an information for the pulse width of the data enable signal received from the second counter;

a pre-gate start pulse time detecting unit that detects a pulse time of the dummy data enable signal synchronized with a pulse time of the line number information and generates the pre-gate start pulse for the pulse time of the dummy data enable signal;

a periodic checking unit that decides a time interval indicating the option information based on a count value of the data enable signal received from the first counter;

a periodic selecting unit that receives an output of the periodic checking unit to invert a selection signal for the pulse time of the dummy data enable signal synchronized with pulses of the option information; and a pulse generating unit that generates the pre-gate start pulse and the real gate start pulse in response to the selection signal.

6. A method of driving a liquid crystal display including a liquid crystal display panel, that includes a plurality of liquid crystal cells arranged at crossings of a plurality of data lines and a plurality of gate lines in a matrix format, the method comprising:

supplying a data voltage, whose a polarity is periodically inverted, to the data lines;

sequentially supplying a first gate pulse synchronized with a first data voltage to the gate lines during a frame period, and sequentially supplies a second gate pulse synchronized with a second data voltage, that has a polarity opposite a polarity of the first data voltage, to the gate lines;

generating a pre-gate start pulse for controlling an output of the first gate pulse during a blank period; and generating a real gate start pulse for controlling an output of the second gate pulse during an initial period of the frame period following the blank period.

7. The method of claim 6, further comprising:

generating dummy digital video data during the blank period, and then generating digital video data to be displayed on the liquid crystal display panel during the frame period; and converting the dummy digital video data into a dummy positive or negative analog data voltage to supply the dummy positive/negative analog data voltage to the data lines, and then converting the digital video data into a positive or negative analog data voltage to supply the positive/negative analog data voltage to the data lines.

8. The method of claim 7, wherein generating the pre-gate start pulse comprises:

extending a supply of pulses of a data enable signal, that are generated at predetermined time intervals during the frame period, to the blank period to generate a dummy data enable signal; and generating the pre-gate start pulse based on the dummy data enable signal during the blank period.

* * * * *